US006981615B2

(12) United States Patent
Tobler

(10) Patent No.: US 6,981,615 B2
(45) Date of Patent: Jan. 3, 2006

(54) MODULAR DILUENT CHANGEOVER MANIFOLD FOR BEVERAGE DISPENSERS

(75) Inventor: Andrew J. Tobler, Franklin Park, IL (US)

(73) Assignee: IMI Cornelius Inc., Glendale Heights, IL (US)

( * ) Notice: Subject to any disclaimer, the term of this patent is extended or adjusted under 35 U.S.C. 154(b) by 13 days.

(21) Appl. No.: 10/842,338

(22) Filed: May 10, 2004

(65) Prior Publication Data

US 2004/0245288 A1 Dec. 9, 2004

Related U.S. Application Data

(60) Provisional application No. 60/469,516, filed on May 9, 2003.

(51) Int. Cl.
*B65D 5/06* (2006.01)

(52) U.S. Cl. ..... 222/129.1; 222/144.5

(58) Field of Classification Search ..... 222/129.1, 222/144.5

See application file for complete search history.

(56) References Cited

U.S. PATENT DOCUMENTS 6,478,192 B2 * 11/2002 Heyes ..... 222/144.5

* cited by examiner

*Primary Examiner*—Philippe Derakshani
(74) *Attorney, Agent, or Firm*—Pyle & Piontek

(57) ABSTRACT

A modular diluent changeover manifold for beverage dispensers provides quick and convenient changeover of supply of two different beverage liquid diluents to post-mix beverage dispensing valves. The diluent changeover manifold is mounted within a beverage dispenser behind a beverage valve mounting panel. The modular changeover manifold and valve assembly, when assembled, consists of a pair of diluent tubes and a plurality of changeover valves. Each changeover valve has an outlet fluidly connected to an associated one of the beverage dispensing valves and each tube supplies a different diluent, such as plain water and carbonated water, to one of two inlets to each changeover valve. The changeover valves are individually manually manipulateable to deliver to their associated beverage valves either the diluent from the first tube or the diluent from the second tube.

14 Claims, 7 Drawing Sheets

MODULAR DILUENT CHANGEOVER MANIFOLD FOR BEVERAGE DISPENSERS

This application claims benefit of provisional application Ser. No. 60/469,516, filed May 9, 2003.

FIELD OF THE INVENTION

The present invention relates generally to beverage dispensing systems, and in particular to a modular diluent changeover system for beverage dispensers that allows for quick and convenient changeover between supply of carbonated water and plain water to beverage dispensing valves.

BACKGROUND OF THE INVENTION

Ice/beverage dispensers are often contained in a single cabinet, in an upper portion of which is an ice retaining hopper and in a lower portion of which is a cold plate. The cold plate is cooled by a volume of ice that is gravity delivered from a lower opening in the hopper into the lower portion of the cabinet and onto and in heat exchange contact with the cold plate. The cold plate provides for heat exchange cooling of beverage liquids flowed through tubing circuits embedded in the cold plate, which beverage liquids include mixing or diluent liquids such as carbonated water and noncarbonated or plain water. In situations where a cold plate is used in conjunction with a post-mix ice/beverage dispenser, sources of carbonated water, plain water and beverage syrup concentrate are connected to the cold plate to be cooled as they are passed through the cold plate circuits and are then delivered through tubing to post-mix beverage dispensing valves. A carbonated or noncarbonated drink is produced when the cooled carbonated or plain water and a syrup concentrate are subsequently mixed together and dispensed from a dispensing valve.

An ice/beverage dispenser customarily has four or more, usually eight or more, post-mix beverage dispensing valves for dispensing various beverages. In the past, each post-mix valve was plumbed for and dedicated to dispensing either carbonated or non-carbonated drinks and the use of several dispensing valves on a beverage dispenser enabled a variety of different drinks to be offered. When a post-mix valve is activated to dispense a selected drink, a syrup concentrate for the drink is mixed with carbonated water when a carbonated drink is to be dispensed or with plain water when a non-carbonated drink is to be dispensed.

Because customers' tastes change, owners of beverage dispensers are often required to change the supplies of concentrate syrup and carbonated and plain water delivered to dispensing valves in order to provide new drink flavors or, perhaps, to enable the dispensing of the same drink flavor from more than one dispensing valve of the same beverage dispenser. While in the past each valve was dedicated to dispensing either a carbonated or a non-carbonated drink, today there is desire to have the flexibility to be able to change between dispensing carbonated drinks, such as soda pop, and noncarbonated drinks, such as juice and sports beverages with the same valve. Historically, each beverage dispensing valve was coupled to a pair of beverage liquid delivery lines, one a delivery line for concentrate syrup flavoring and the other a delivery line for either carbonated or noncarbonated water, with each line leading back to a source of the particular beverage liquid. As a result, reconfiguring a valve to dispense a different beverage required the tedious and often expensive task of reconfiguring the beverage delivery lines through disconnection and appropriate reconnection of the lines, which lines were often relatively inaccessible and access to which required partial disassembly of the beverage dispenser.

To alleviate the problem of reconfiguring individual beverage liquid delivery lines to post-mix valves of a beverage dispenser, mounting assemblies for post-mix dispensing valves have been used. Such mounting assemblies provide two outlets for a beverage dispensing valve, one for delivering concentrate beverage syrup to the valve and the other for delivering either carbonated or noncarbonated water. The mounting assemblies conventionally have two inlets, one for being connected to a supply of concentrate beverage syrup and the other for being connected to a supply of either carbonated or plain water. Because only one inlet is provided for both carbonated and plain water, to change between carbonated and noncarbonated drinks dispensed by a valve still requires disassembly of the beverage dispenser to access the carbonated and noncarbonated water sources and a subsequent resetting of pressure and flow rates when the dispenser is reassembled.

Accordingly, there is a need for a beverage liquid supply arrangement for post-mix beverage dispensing valves of a beverage dispenser that enables quick, convenient and inexpensive interchange of supply of either carbonated or noncarbonated water to any particular beverage dispensing valve, without need to disassemble the beverage dispenser and reset pressures and flow rates.

There also is a need for such a beverage liquid supply arrangement that can conveniently and inexpensively be configured for use with a dispenser having any particular number of beverage dispensing valves.

OBJECTS OF THE INVENTION

An object of the present invention is to provide a modular dual diluent changeover system for a beverage dispenser having a plurality of post-mix beverage dispensing valves, which changeover system allows for convenient selection of one of two diluents, such as carbonated and noncarbonated water, for delivery to each dispensing valve.

Another object is to provide such a modular dual diluent changeover system that can readily be configured to any selected size for use with dispensers having any particular number of beverage dispensing valves.

SUMMARY OF THE INVENTION

The present invention comprises a modular dual diluent changeover manifold and valve assembly that allows for quick and convenient changeover of post-mix beverage dispensing valves as between dispensing carbonated or non-carbonated drinks. In accordance with the invention, the modular changeover manifold and valve assembly permits selective direction of either of two liquid diluents to any of two or more beverage dispensing valves secured to a beverage dispensing machine. The manifold and valve assembly comprises a plurality of physically separate changeover valve assemblies, each for delivering a selected one of the two diluents to an associated one of the beverage dispensing valves of the beverage dispensing machine. Each changeover valve assembly has first and second tubes for being fluid coupled to respective supplies of the first and second liquid diluents, a first inlet fluid coupled to the first tube, a second inlet fluid coupled to the second tube, an outlet for being fluid coupled to the associated beverage dispensing valve, and manually manipulateable diluent changeover means for selectively establishing a fluid connection between one of the first and second inlets and the outlet while blocking fluid connection between the other inlet and the outlet. In addition, the manifold and valve assembly includes means for releasably connecting together the pluralists of physically separate changeover valve assemblies.

The means for releasably connecting fluid couples together all the first tubes and also fluid couples together all the second tubes of the plurality of changeover valve assemblies. In the described embodiment, the means for releasably coupling includes a plurality of physically separate connectors, each connector being releasably connected to and between an associated pair of the changeover valve assemblies to connect the changeover valve assemblies in a chain. The connectors provide inline fluid connections between all of the first tubes and inline fluid connections between all of the second tubes of the pair of changeover valve assemblies. One of the connectors includes first inlet means that is fluid coupled to the first conduit and is for connection to a supply of one of the liquid diluents as well as second inlet means that is fluid coupled to the second conduit and is for connection to a supply of the other of the liquid diluents. Further included are end stop plugs for closing outer opposite ends of the first and second tubes of the outermost changeover valve assembling.

DETAILED DESCRIPTION

Figure 1:
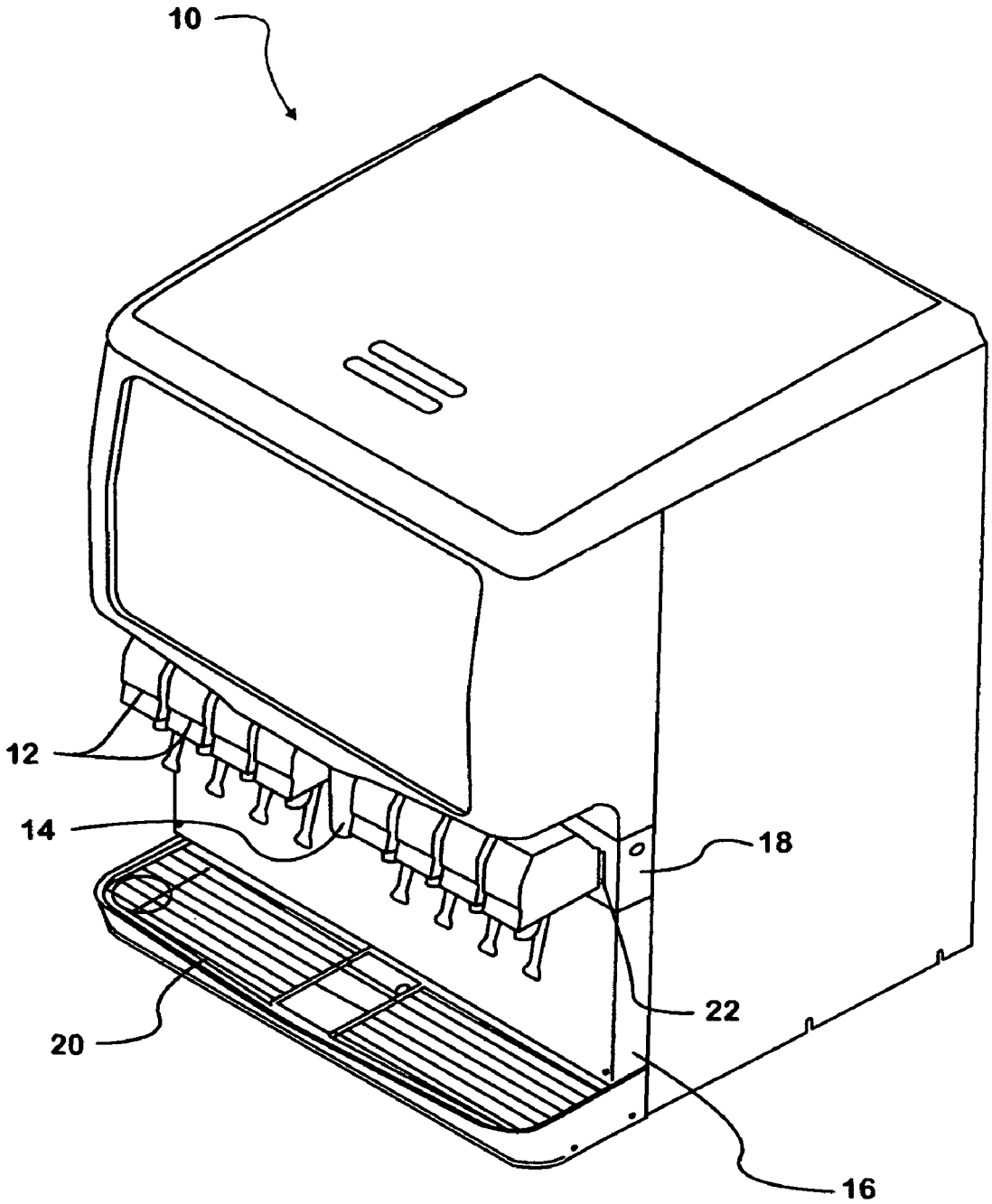
FIG. 1 is a perspective view of a post-mix beverage dispenser of a type with which the present invention may be used.
Figure 2:
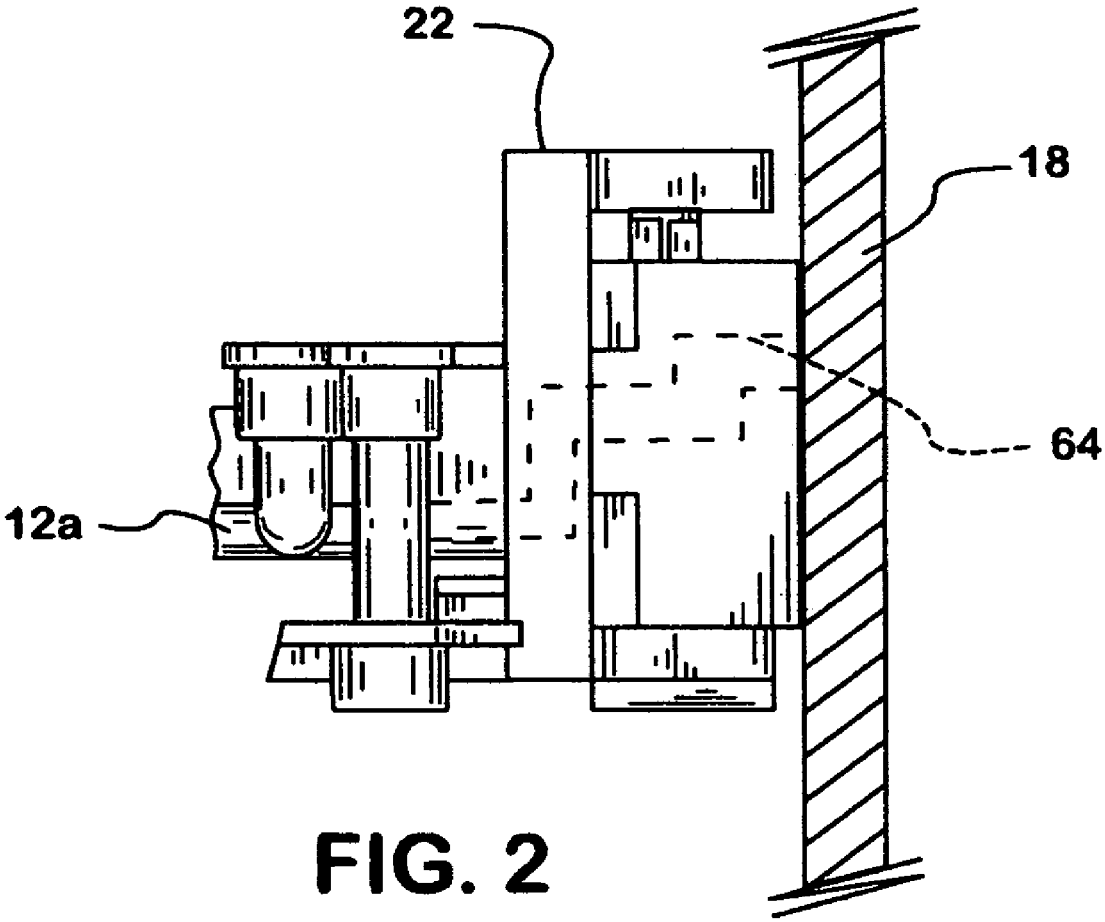
FIG. 2 is a side elevation view of a valve quick disconnect mounting block secured to a valve mounting panel.

A changeover manifold and valve assembly according to the present invention is adapted for use with beverage dispensers, such as a post-mix ice/beverage dispensers of a type shown in FIG. 1 and indicated generally at 10. The dispenser 10 can be of the electrically cooled or ice cooled variety and includes a plurality (eight as shown) of post-mix beverage dispensing valves 12, a centrally located ice dispensing chute 14, a removable splash panel 16, a valve mounting panel 18 and a drip tray 20. To accommodate mounting of the post-mix dispensing valves 12 on the valve mounting panel 18, as seen in FIG. 2*a* body 12*a* of each dispensing valve is removably secured to an associated quick-disconnect mounting block 22 that in turn is carried by the valve mounting panel.

Figure 3:
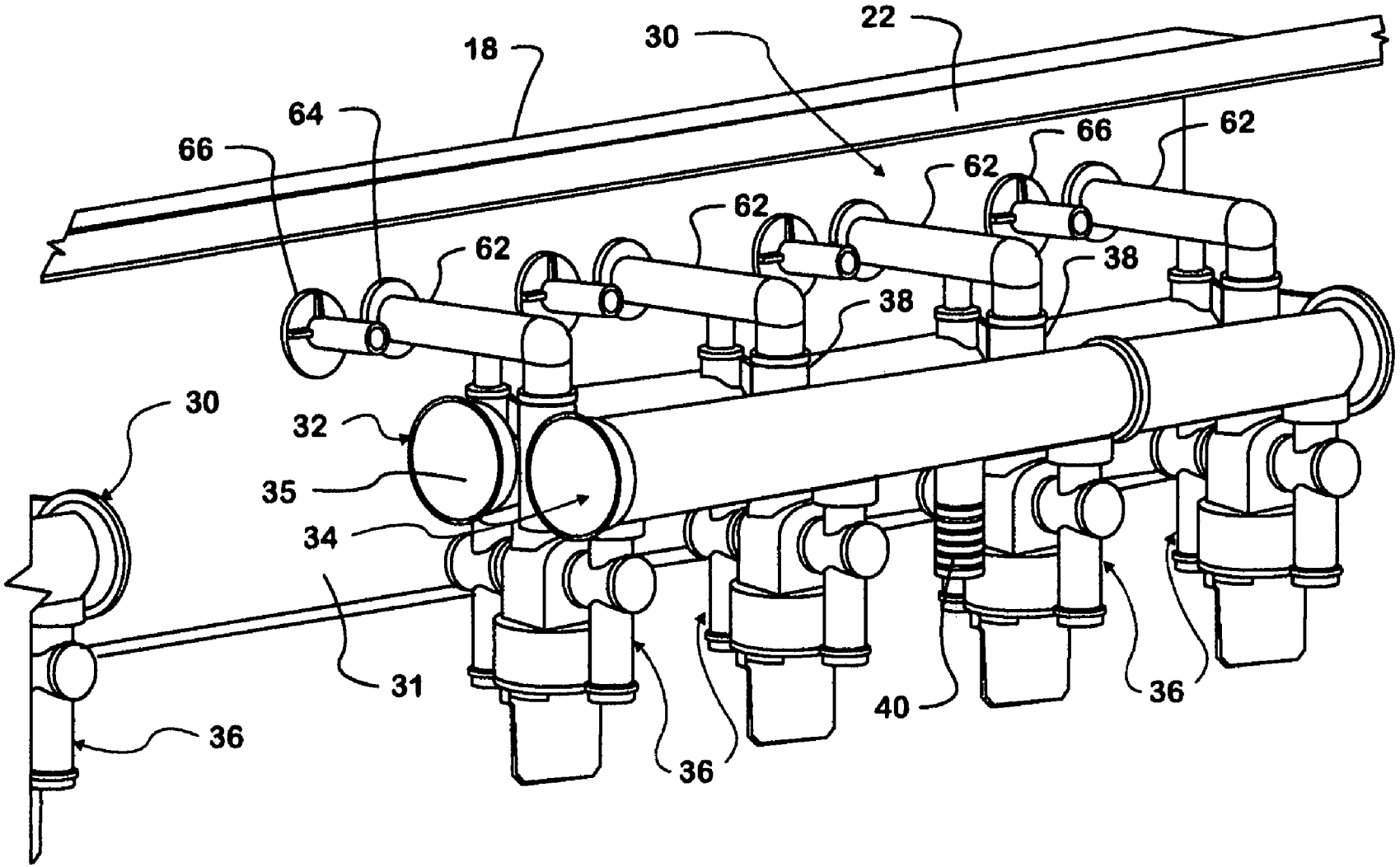
FIG. 3 is a perspective view of a changeover manifold and valve assembly mounted to a rear side of the valve mounting panel.

Referring also to FIG. 3, a changeover manifold and valve assembly is indicated generally at 30 and is located within the dispenser 10 behind the valve mounting panel 18. The changeover manifold and valve assembly 30 is structured to provide for convenient changeover between one of two diluents supplied to each of four of the eight post-mix beverage dispensing valves 12 that are secured to quick-disconnect mounting blocks 22 of the dispenser 10 on one side of the ice dispensing chute 14. Accordingly, a further and identical changeover manifold and valve assembly 30 is provided for the other four beverage dispensing valves 12 on the opposite side of the ice dispensing chute 14, such that there is a separate changeover manifold and valve assembly servicing the post-mix beverage dispensing valves 12 on each side of the ice dispensing chute. The two changeover manifolds and valve assemblies 30 are separated by a space 31 on a back side of the valve mounting panel 18 that corresponds to a gap that exists between each set of four valves 12 to accommodate the ice dispensing chute 14.

Figure 4:
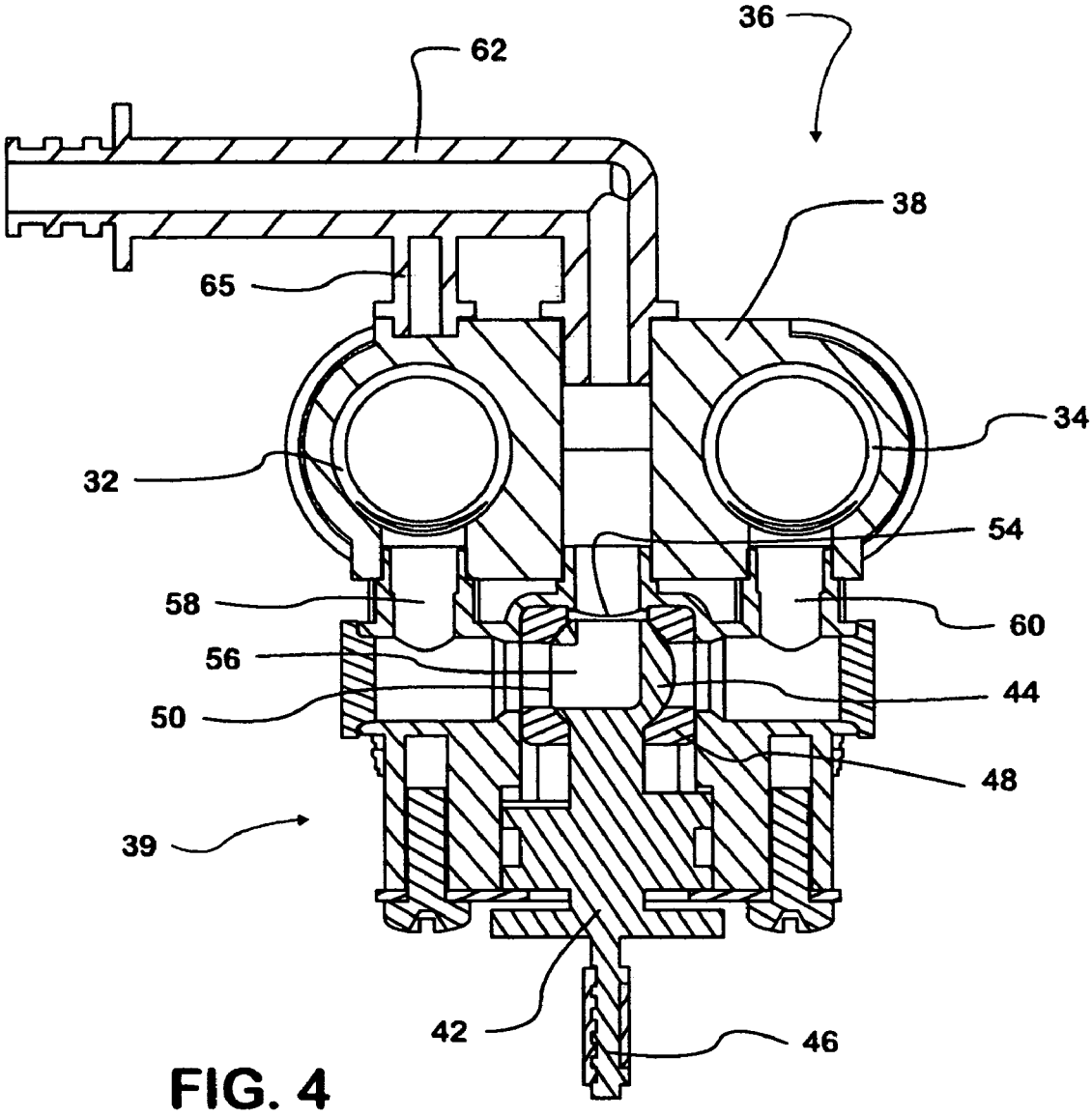
FIG. 4 is a cross-sectional side elevation view of the changeover manifold and valve assembly of FIG. 3.

Referring also to FIG. 4, each changeover manifold and valve assembly 30 includes two diluent delivery tubes 32 and 34 that are sealed closed at opposite ends 35. Each manifold and valve assembly 30 also includes a plurality of diluent changeover valve assemblies, indicated generally at 36, which plurality comprises four changeover valves for the embodiment shown where four post-mix beverage dispensing valves 12 to be serviced are on each side of the ice dispensing chute 14. The changeover valves 36 are secured to, along and between the tubes 32 and 34 by webbing flanges 38 that also serve to support the tubes in parallel and spaced relationship. Each diluent delivery tube 32 and 34 includes an associated inlet 40 for fluid connection to a respective cooled source of diluent, such as plain or carbonated water. For the purpose of describing the invention, the diluent delivery tube 32 will be considered to be connected to a carbonated water source and the diluent delivery tube 34 to a plain or non-carbonated water source.

Each changeover valve 36 has a valve body, indicated generally at 39, in which is carried a ball valve structure 42. The ball valve structure 42 includes a ball valve end 44 and a manually rotatable valve operating tab 46. The ball valve end 44 rotates within a flexible seal and seat 48 and includes a side fluid inlet orifice 50 and a top fluid outlet orifice 54 at opposite ends of a generally L-shaped channel 56 extending through the ball valve end. Each changeover valve 36 also includes a first inlet channel 58 for providing fluid connection to the tube 32 and carbonated water in the tube and a second inlet channel 60 for providing fluid connection to the tube 34 and non-carbonated or plain water in the tube. Each valve 36 carries an outlet tube 62 for fluid connection at an end thereof remote from the valve to a diluent fluid inlet 64 of an associated quick disconnect block 22. To securely mount the outlet tubes 62, each is provided with a support arm 65 that is carried by an associated flange 38. As is conventional, the quick-disconnect valve mounting blocks 22 include syrup inlets 66 for fluid connection to sources of concentrate beverage syrups.

For the orientation of the ball valve end 44 as shown in FIG. 4, plain water from the tube 34 is blocked from entering the changeover valve 36 while carbonated water from the tube 32 flows into the side inlet orifice 50 of the ball valve end 44 and into and through the L-shaped channel 56 to and out of the top outlet orifice 54 and then into and through the outlet tube 62 and ultimately t) a particular post-mix beverage dispensing valve 12 via an inlet 64 to an associated quick disconnect block 22 that mounts the dispensing valve. Should it be desired to supply plain non-carbonated water from the tube 34 to the dispensing valve 12, rotation of the ball valve structure 42 through 180 by manual rotation of the tab 46 will place the inlet 50 to the L-shaped channel 56 in the ball valve end 44 into fluid connection with plain water in the tube 34 while the ball valve end then blocks fluid communication between the L-shaped channel and carbonated water in the tube 32, so that plain water from the tube 34 will then be delivered to the beverage dispensing valve 12.

In this manner, changing the diluent (carbonated or plain water) delivered to any particular post-mix beverages dispensing valve 12 is easily and quickly accomplished by removal of the splash panel 16 at the front of the dispenser 10 for access to the changeover valves 36 carried on the rear of the valve mounting panel 18. The operating tabs 46 of the changeover valves 36 are positioned to extend below the valve mounting panel 18, so removal of the splash panel 16 provides direct and easy access to the operating tabs of the changeover valves, whereby the diluent delivered to any particular one or more of the post-mix beverage dispensing valves 12 may quickly and conveniently be manually changed from carbonated to non-carbonated water, or vice versa, simply by manually rotating a selected one or more of the operating tabs. For added convenience, the changeover valve operating tabs 46 advantageously include indicia to indicate whether the valve is set to deliver carbonated or plain water to its associated post-mix beverage dispensing valve 12.

The changeover manifold and valve assembly 30, while highly useful in enabling quick and convenient changeover of diluent delivered to individual beverage dispensing valves 12 of a beverage dispenser 10, has a one-piece manifold and must therefore initially be manufactured to be of a size, and to carry a number of changeover valves, in accordance with the number of beverage dispensing valves provided on a dispenser 10 which are to be served by the changeover manifold and valve assembly. Consequently, since all beverage dispensers do not have the same number of beverage dispensing valves, a number of different sizes of changeover manifolds and valve assemblies 30 must be manufactured and maintained in inventory for installation in beverage dispensers.

Figure 5:
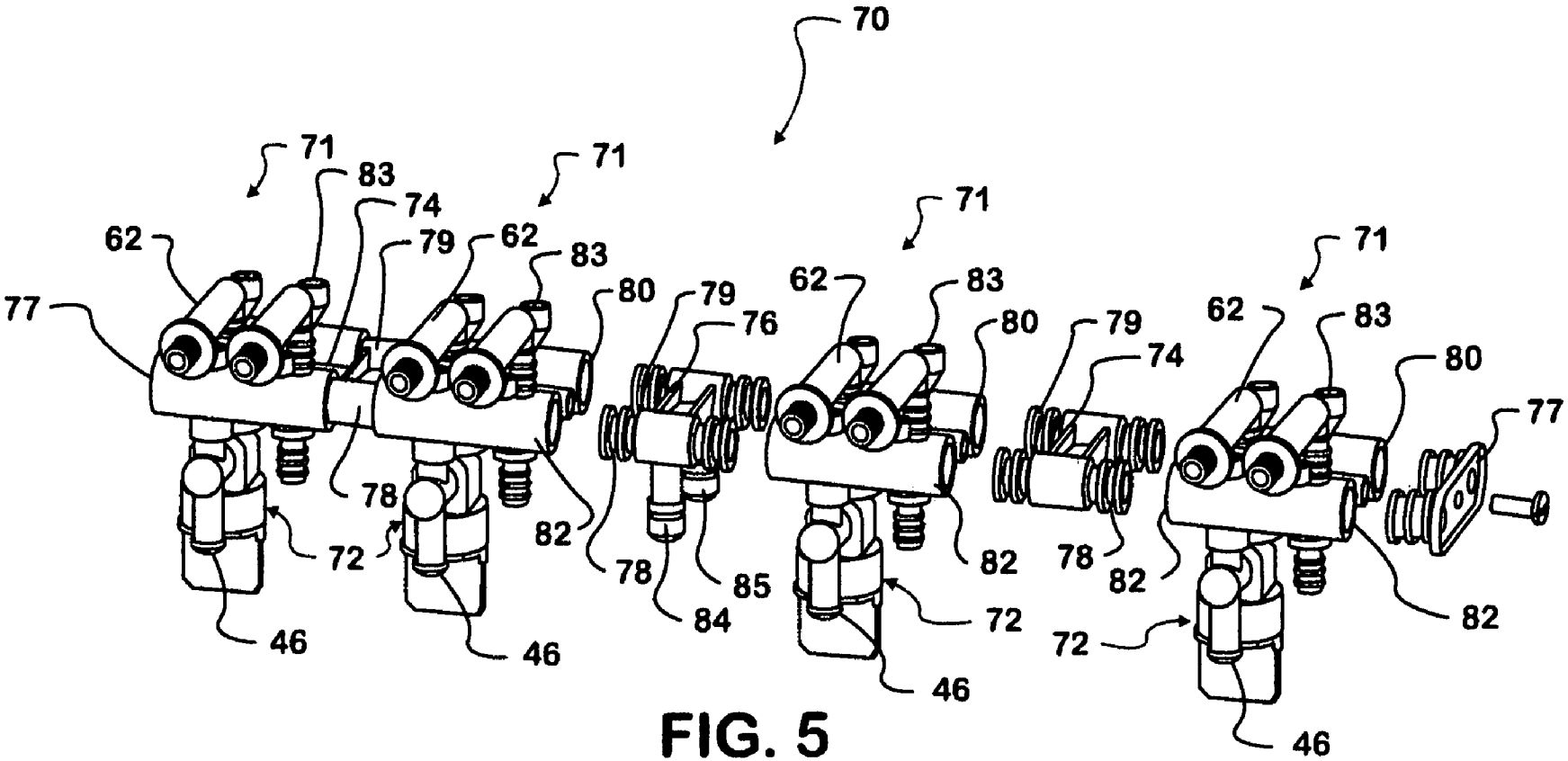
FIG. 5 is an assembly view of a modular changeover manifold and valve assembly according to the present invention.
Figure 6:
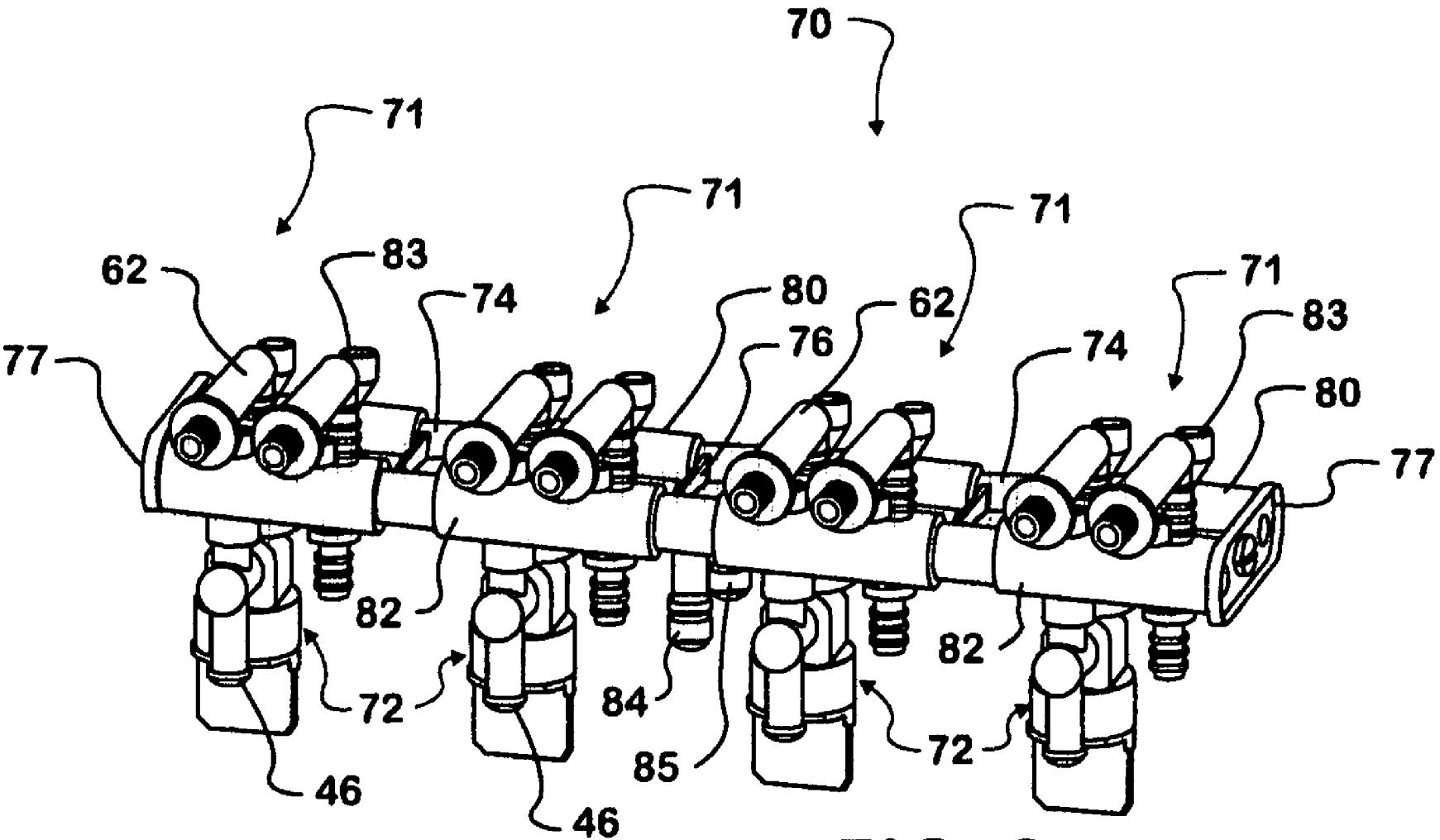
FIG. 6 shows a perspective view of the modular changeover manifold and valve assembly of FIG. 5.
Figure 7:
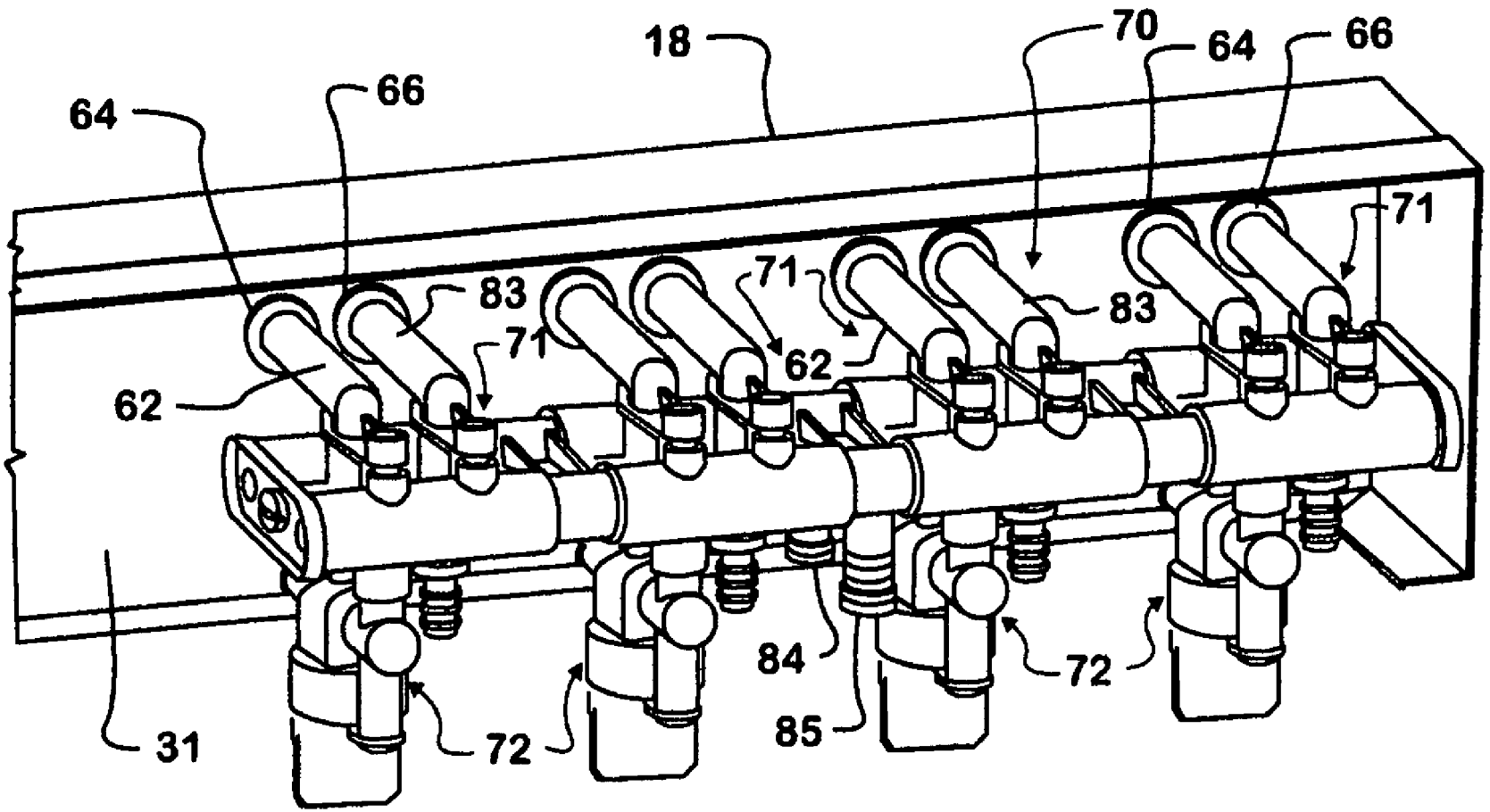
FIG. 7 is a perspective view of the modular changeover manifold and valve assembly of FIG. 6 mounted on a rear side of the valve mounting panel.

To advantageously avoid the need to manufacture and maintain an inventory of a number of different sizes of changeover manifolds and valve assemblies 30, the present invention provides a modular embodiment of changeover manifold and valve assembly, as seen in FIGS. 5, 6 and 7 and indicated generally at 70. The modular manifold and valve assembly 70 is comprised of a limited number of parts and can readily be assembled to be of any particular size, i.e., to have any desired number of changeover valves, depending upon the number of beverage dispensing valves of a beverage dispenser with which the changeover manifold and valve assembly is to be used. The manifold and valve assembly 70, when its individual components are interconnected and assembled together, is somewhat similar to the changeover manifold and valve assembly 30, but differs from the assembly 30 in that it comprises physically separate and distinct changeover valve assemblies, indicated generally at 71. Each changeover valve assembly 71 includes a changeover valve, indicated generally at 72, two inlets to which are fluid coupled to respective manifold diluent supply tubes 80 and 82 of the valve assembly 71 and an outlet from which is connected to a diluent outlet tube 62. The changeover valve assemblies 71 are interconnected or chained together by physically separate and distinct fluid manifold connectors 74 and 76 of the manifold and valve assembly 70, each having a pair of fluid conduits 78 and 79 that are placed inline and in fluid coupled relationship with respective ones of the diluent supply tubes 82 and 80 of the changeover valve assemblies 71. The manifold and valve assembly 70 further includes a pair of separate and distinct end stop plugs 77 that closes outer opposite ends of the diluent supply tubes 80 and 82 of outer opposite valve assemblies 71.

The changeover valves 72 have manually rotatable operating tabs 46 and otherwise correspond in form and function to the changeover valves 36 in delivering diluent from a selected inlet to the changeover valve to the outlet from the valve and into and through the outlet tube 62. For the purpose of forming secure fluid connections, opposite ends of the pairs of fluid conduits 78 and 79 of the connectors 74 and 76, which are received in ends of the tubes 80 and 82 of the changeover valve assemblies 71 that are on opposite sides of each connector, have annular recesses for receiving suitable sealing devices such as O-rings (not shown). Assembly of the changeover manifold and valve assembly 70 is accomplished by extending opposite ends of the pairs of fluid conduits 78 and 79 of the connectors 74 and 76 into sealed relationship with adjacent opposing ends of a pair of diluent tubes or channels 80 and 82 of a pair of changeover valve assemblies 71 that are to opposite sides of the connectors 74 and 76, and by then attaching a pair of end stop plugs 77 over opposite outer openings from the tubes 80 and 82 of opposite outer changeover valve assemblies 71. Only one connector 76 is used in each changeover manifold and valve assembly 70, and although the connector 76 is shown positioned generally intermediate the changeover valve assemblies 71, it can be positioned between any other two changeover valves in the chain. In addition to an outlet tube 62 that is connected at an inlet end to a diluent outlet from each changeover valve 72, each changeover valve assembly also carries a somewhat similar tube 83 having an inlet for connection to an associated supply of syrup and an outlet for connection to a syrup inlet 66 an associated quick-disconnect block 22 for delivery of flavored syrup to a beverage valve.

In the assembled state of the modular changeover manifold and valve assembly 70 as shown in FIGS. 6 and 7, the fluid conduits 78 and 79 of the connectors 74 and 76 provide for inline fluid connectivity and continuity of the diluent tubes or channels 80 and 82 of the changeover valve assemblies 71, which tubes 80 and 82 correspond in form and function to the tubes 32 and 34 of the changeover valves 36. The end stop plugs 77 serve to seal off and close otherwise open opposite outer ends of the channels 80 and 82, and the connector 76 has two diluent inlets 84 and 85, one for connection to a source of carbonated water (not shown) and the other for connection to a source of plain non-carbonated water (also not shown) to be delivered into respective ones of the tubes 82 and 80. The diluent inlets 84 and 85 correspond in form and function to the pair of inlets 40 of the changeover manifold and valve assembly 30.

In its assembled state, the modular changeover manifold and valve assembly 70 functions in the same manner as described in respect of the changeover manifold and valve assembly 30, with outlets from the diluent delivery tubes 62 being fluid coupled to diluent inlets 64 to the quick-connect blocks 22 and outlets from the syrup flavoring delivery tubes 83 being fluid coupled to syrup inlets 66 to the quick-connect blocks, for delivery of diluent and syrup to beverage dispensing valves 12 mounted by the quick-disconnect blocks. However, as compared with the changeover manifold and valve assembly 30, the modular manifold and valve assembly 70 has the added advantageous ability to gang together any number of individual changeover valve assemblies 71 to readily accommodate delivery of beverage liquids to any particular number of beverage dispensing valves 12 of a dispenser 10. Thus, the assembly 70 can easily be fabricated out of a small number of identical parts to produce a changeover manifold and valve assembly of any desired size and having any desired number of changeover valve assemblies 71, depending upon the number of post-mix beverage dispensing valves of a beverage dispenser that are required to be served with beverage liquids. Such a modular approach desirably reduces manufacturing costs by eliminating a need to otherwise manufacture and maintain in inventory a variety of differently sized changeover manifold and valve assemblies, such as assemblies of the type represented by the assembly 30, each of which is useable only with a beverage dispenser having a particular number of valves.

Although a particular structure of the modular changeover manifold and valve assembly 70 has been described, other embodiments are contemplated. For example, the changeover valve assemblies 71 need not necessarily employ ball valve type changeover valves 72, but instead any suitable valve means may be used for switching the particular diluent delivered to a beverage dispensing valve 12, such as a plurality of gate valves or other suitable types of valves, or for that matter valve means comprising tubular or similar types of connectors that may be selectively manually connected between diluent supply outlets and diluent delivery inlets to deliver a selected diluent to a dispensing valve while blocking delivery of a non-selected diluent. In addition, while O-rings are described for use as seals between the connectors 74 and 76 and the changeover valve assemblies 71, other suitable means for effecting seals may be employed. Further, while separate connectors 74 and 76 have been described as interconnecting the changeover valve assemblies 71 and their carbonated and plain water diluent tubes so and 82, it is contemplated that the changeover valve assemblies may themselves be provided with suitable fluid coupling means, so that physically separate changeover valve assemblies might be directly coupled together to fluidly interconnect their carbonated and plain water diluent tubes without using the separate fluid coupling connectors 74 and 76.

While embodiments of the invention have been described in detail, various modifications and other embodiments thereof may be devised by one skilled in the art without departing from the spirit and scope of the invention, as defined in the appended claims

What is claimed is:

1. A modular dual diluent changeover system for directing a selected one of two liquid diluents to individual ones of a plurality of beverage dispensing valves of a beverage dispenser, comprising:

a plurality of physically separate diluent changeover valve assemblies, each for delivering a selected one of the two liquid diluents to an associated beverage dispensing valve of the beverage dispenser and having a first inlet for being fluid coupled to a supply of a first diluent, a second inlet for being fluid coupled to a supply of a second diluent, an outlet for being fluid coupled to the associated beverage dispensing valve, and manually manipulateable diluent changeover means for selectively establishing a fluid connection between one of said first and second inlets and said outlet while blocking fluid connection between the other inlet and said outlet; and means for mechanically connecting said plurality of changeover valve assemblies.

2. A system as in claim 1, including means for fluid coupling all of said first inlets to a common supply of the first diluent and all of said second inlets to a common supply of the second diluent.

3. A system as in claim 1, wherein each said changeover valve assembly includes a first tube for fluid connection to a supply of the first diluent and a second tube for fluid connection to a supply of the second diluent, said first and second inlets of each said changeover valve assembly being fluid coupled to respective ones of said first and second tubes.

4. A system as in claim 3, wherein said means for mechanically connecting fluid couples together all of said first tubes and fluid couples together all of said second tubes of said plurality of changeover valve assemblies.

5. A system as in claim 1, wherein said means for mechanically coupling includes a plurality of connectors, each for being mechanically connected to and between a pair of said changeover valve assemblies.

6. A system as in claim 5, wherein said means for mechanically coupling includes a plurality of connectors each for being mechanically connected to and between a pair of said changeover valve assemblies to provide inline fluid connections between all of said first tubes and between all of said second tubes of said plurality of changeover valve assemblies.

7. A system as in claim 6, wherein one of said connectors includes means for connection to supplies of the first and second diluents for delivering the first and second diluents to and through respective ones of said first and second tubes of said plurality of changeover valves.

8. A modular changeover manifold and valve assembly for permitting selective direction of either of two liquid diluents to any of two or more dispensing valves secured to a beverage dispensing machine, comprising:

a plurality of physically separate changeover valve assemblies, each for delivering a selected one of the two diluents to an associated one of the beverage dispensing valves and having first and second tubes, a first inlet fluid coupled to said first tube, a second inlet fluid coupled to said second tube, an outlet for being fluid coupled to the associated beverage dispensing valve, and manually manipulateable diluent changeover means for selectively establishing a fluid connection between one of said first and second inlets and said outlet while blocking, fluid connection between said other inlet and said outlet; and means for mechanically connecting together said plurality of physically separate changeover valve assemblies.

9. An assembly as in claim 8, wherein said means for mechanically connecting fluid couples together all said first tubes and fluid couples together all said second lubes of said plurality of changeover valve assemblies.

10. An assembly as in claim 8, wherein said means for mechanically coupling includes a plurality of physically separate connectors each mechanically connected to and between an associated pair of said changeover valve assemblies.

11. An assembly as in claim 8, wherein said means for mechanically coupling includes a plurality of physically separate connectors each mechanically connected to and between an associated pair of said changeover valve assemblies and providing inline fluid connections between said first tubes and inline fluid connections between said second lubes of said pair of changeover valve assemblies.

12. An assembly as in claim 8, wherein said means for mechanically coupling includes a plurality of physically separate connectors each having first and second fluid conduits and each being mechanically connected to and between an associated pair of said changeover valve assemblies with said first conduit fluid coupled inline between said first tubes and said second conduit fluid coupled in inline between said second tubes of said associated pair of changeover valve assemblies.

13. An assembly as in claim 12, wherein one of said connectors includes first fluid inlet means to said first conduit for connection to a supply of one of the liquid diluents and second fluid inlet means to said second conduit for connection to a supply of the other of the liquid diluents.

14. An assembly as in claim 9, including a pair of end stop plugs for closing opposite outer opposite ends of said first and second tubes of opposite outer changeover valve assemblies.

* * * * *